US007524340B2

(12) United States Patent
May

(10) Patent No.: US 7,524,340 B2
(45) **Date of Patent: *Apr. 28, 2009**

(54) CATALYST AND METHOD FOR IMPROVING COMBUSTION EFFICIENCY IN ENGINES, BOILERS, AND OTHER EQUIPMENT OPERATING ON FUELS

(76) Inventor: Walter R. May, 800 Country Place Dr., #1305, Houston, TX (US) 77055-5559

( * ) Notice: Subject to any disclaimer, the term of this patent is extended or adjusted under 35 U.S.C. 154(b) by 124 days.

This patent is subject to a terminal disclaimer.

(21) Appl. No.: 10/424,415

(22) Filed: Apr. 28, 2003

(65) Prior Publication Data

US 2003/0192232 A1 Oct. 16, 2003

Related U.S. Application Data

(63) Continuation-in-part of application No. 10/417,547, filed on Apr. 17, 2003, now Pat. No. 6,881,235.

(60) Provisional application No. 60/373,249, filed on Apr. 17, 2002, provisional application No. 60/304,579, filed on Jul. 11, 2001.

(51) Int. Cl.
*C10L 1/18* (2006.01)
*C10L 1/24* (2006.01)

(52) U.S. Cl. ..... 44/457; 44/363; 44/365

(58) Field of Classification Search ..... 44/363, 44/365, 457
See application file for complete search history.

(56) References Cited

U.S. PATENT DOCUMENTS 3,332,755 A * 7/1967 Kukin ..... 44/603
4,104,180 A * 8/1978 Burnop ..... 508/392
5,145,488 A 9/1992 Weber et al.
6,881,235 B2 * 4/2005 May ..... 44/363

OTHER PUBLICATIONS

Edited by Eliot, Boiler Fuel Additives for Pollution Reduction and Energy Savings, 1978, pp. 67-72.
Rising, B., Particulate Emission Reduction Using Additives, Technical Paper TP-98010, Jan. 9, 1998, Westinghouse Power Corp., Orlando, FL 32826-2399.
Dr. Walter May, Combustion Turbine Exhaust Particulate Emission Reduction: A Mechanistic Discussion, dated Jun. 2002.
Catalyst for Improving the Combustion Efficiency of Diesel Fuels, by Dr. Walter May, dated Sep. 2002, Mumbai, India; India Oil & Gas Review Symposium.

* cited by examiner

*Primary Examiner*—Cephia D Toomer

(57) ABSTRACT

A catalyst and method for improving combustion efficiency in boilers, engines, and other equipment by adding to fossil and other fuels a fuel additive that contains an oil-soluble iron compound and an over-based magnesium compound and for which the median particle size of the additive is less than about 0.01 micrometers.

20 Claims, 4 Drawing Sheets

COMPARISON OF MEDIAN PARTICLE SIZE FOR THE PRESENT INVENTION (smaller median particle size) AND THE TYPICAL CATALYST (larger median particle size) USED IN HYDROCARBON FUELS

Line A - the present invention Line B - the typical catalyst

COMPARISON OF MEDIAN PARTICLE SIZE FOR THE PRESENT INVENTION (smaller median particle size) AND THE TYPICAL CATALYST (larger median particle size) USED IN HYDROCARBON FUELS

Line A - the present invention Line B - the typical catalyst

ACTIVATION ENERGY FOR COMBUSTION CATALYST REACTIONS WITH (top curve) AND WITHOUT (bottom curve) THE COMBUSTION CATALYST OF THE PRESENT INVENTION

Line A (on bottom) Line B (on top)

PARTICULATE MATTER AND CATALYST CONCENTRATION
The Present Invention (bottom curve) and the Typical Catalyst (top curve)

FIGURE 4
MAJOR ATOMIC SPECTRA LINES FOR IRON(III) AND MAGNESIUM

| Iron | | Magnesium | |
|---|---|---|---|
| Wavelength | Intensity | Wavelength | Intensity |
| 2,151.78 | 15 | | |
| 2,174.66 | 15 | | |
| | | 2,795.53 | 1,000 |
| | | 2,825.70 | 600 |
| | | 2,852.13 | 6,000 |
| 3,013.17 | 15 | | |
| | | 3,832.30 | 300 |
| | | 3,838.29 | 50 |
| 3,954.33 | 16 | | |
| 4,164.73 | 18 | | |
| 4,296.85 | 16 | | |
| 4,304.78 | 18 | | |
| 4,310.36 | 20 | | |
| 4,372.81 | 18 | | |
| 5,243.31 | 18 | | |
| 5,276.48 | 15 | | |
| 5,282.30 | 16 | | |
| 5,833.93 | 18 | | |
| 5,891.91 | 15 | | |
| 5,929.69 | 18 | | |
| 5,999.54 | 18 | | |
| 6,032.59 | 16 | | |

CATALYST AND METHOD FOR IMPROVING COMBUSTION EFFICIENCY IN ENGINES, BOILERS, AND OTHER EQUIPMENT OPERATING ON FUELS

RELATED APPLICATIONS

This application is a continuation in part of U.S. application Ser. No. 10/417,547 filed on Apr. 17, 2003 now U.S. Pat. No. 6,881,235, which claims priority to U.S. Application Ser. No. 60/373,249, filed on Apr. 17, 2002, and of U.S. application Ser. No. 10/192,261, which claims priority to U.S. Patent Application Ser. No. 60/304,579, filed on Jul. 11, 2001.

BACKGROUND OF THE INVENTION

1. Technical Field

The present invention relates in general to a fuel additive that is a combustion catalyst, and in particular to an additive containing an over-based magnesium compound combined with a soluble iron compound for which the median particle size in the additive is less than about 0.01 micrometers.

1. Description of the Prior Art

Energy can be produced by the combustion of fuels in combustion equipment, such fuels including but not limited to fossil fuels such as liquid petroleum, solid hydrocarbon fuels, and other fuel products, including wood fuels. A common concern is the reduction of particulate emissions from such combustion equipment. Another common concern is increasing fuel efficiency in such equipment. The use of combustion catalysts has been shown to generate results with regard to both of these concerns.

One example of a fuel used in such combustion equipment is petroleum fuel. Refining of petroleum consists principally of separating fractions of the oil according to distillation fractions. Following removal of gas, the first boiling fraction is No. 1 fuel or naphtha. The next fraction, No. 2 fuel, is up to the limit of atmospheric distillation. This fraction includes gasoline fuel, kerosene and jet fuels. No. 4 fuel is the portion distilled under vacuum. No. 6 fuel is the residual fuel left behind following vacuum distillation. (No. 3 and No. 5 are usually mixtures.) The naphtha fraction contains a wide range of molecular structures with low-molecular weight. Some of these structures yield high octane numbers and other structures low octane. During most of the $20^{th}$ century, a large amount of the portion with low octane number could be used with octane enhancing products.

Many chemical compounds have been used over the past century to improve octane number as engine efficiencies have increased with higher compression ratios. The use, and subsequent banning, of lead has been known for a long time. Tetraethyl lead showed a positive effect on octane and a profoundly negative effect on the environment. Catalytic cracking will accomplish the same result of increasing octane number, but with an enormous fixed cost in equipment. Catalytic cracking of residual fuel has been used to increase the volume of high-octane naphtha grade fuels. These processes are extremely efficient leading to 40% or more of the barrel of crude available for use as gasoline.

In addition to tetraethyl lead, several elements are known to have combustion catalyst characteristics. Examples, in addition to lead, are manganese, iron, copper, cerium, calcium and barium. Each of these elements has advantages and disadvantages in particular applications. In the past, iron has been evaluated, mainly in the form of bis-cyclopentadienyl iron (0) or ferrocene. Drawbacks of ferrocene include limited solubility in gasoline, toxicity, and expense as an additive. Other iron compounds in oil soluble form or as dispersions have been evaluated with similar drawbacks of toxicity and expense. Iron products typically increase the Real Octane Number or RON by about 2 units. However, iron compounds typically react with sulfur in the naphtha feed stock to form iron sulfide precipitate, which is undesirable.

Another commonly used additive in gasoline is MTBE. While this compound boosts octane levels significantly, the compound is thought to be carcinogenic. Also, it mixes easily with water which is hazardous should there be a leak. Gasoline containing MTBE leaking from an underground tank at a gas station could potentially leach into groundwater and contaminate wells. As a result of the believed negative potential of MTBE on the environment, ethanol is also being evaluated as a gasoline additive to boost octane.

The effects of various metals listed above are known to improve combustion in boilers and combustion turbines and metals but these metals are known to vary ash quality. In addition to iron, useful first row transition metals from the periodic table include manganese and copper. Also, various alkaline earth metals (barium, calcium) and others such as cerium, platinum and palladium have been tested. Manganese is most widely used as a combustion catalyst in boilers with residual oil that often contains fuel contaminants, such as vanadium. Platinum and palladium, generally found in catalytic converters, are quite expensive. Manganese, when used alone, also forms low melting deposits and negates effects of magnesium on control of vanadium/sodium/calcium/potassium deposits. Iron catalyzes sulfur trioxide formation from sulfur dioxide increasing "cold end" corrosion (exhaust area) and sulfuric acid "rain" problems. Copper is less effective than either iron or manganese. Calcium forms tenacious deposits with other contaminant metals. Barium forms toxic salts. Cerium is not considered effective because of its higher elemental weight. These metals have been demonstrated to reduce smoke by no more than 50% at concentrations of up to about 50 PPM on a weight/weight basis by Environmental Protection Agency Test Method 5 (EPC M-5). While these metals have been evaluated in turbines and boilers, octane number is not at issue in this environment. Stability of the metal molecules is also not at issue and therefore not tested in boiler and turbines.

In addition to the industry goal of improved combustion efficiency, smoke emissions reduction is also a concern. U.S. Provisional Patent Application Ser. No. 60/373,249 describes a method for reducing smoke and particulate emissions from high speed (>1,000 rpm), high-compression reciprocating spark-ignited engines, such as gasoline engines.

Marine engines, which are substantially different in design and fuel type from spark-ignited engines, have been the subject of research on additives to reduce smoke emissions. Dispersion-type manganese (Mn) and iron (Fe) compounds have been used to reduce smoke emissions in low-speed (150-400 rpm) marine diesel engines. However, these compounds produce solid material in the gaseous phase. Marine diesel engines are capable of tolerating such gaseous phase solid materials because such engines have large piston and bore size tolerances as compared with higher speed gasoline engines. Moreover, marine diesel engines consume large amounts of crankcase oil in the combustion process, which may help to reduce solid material accumulation. Medium (450-1,000 rpm) and high speed (>1,000 rpm) engines cannot tolerate high levels of contamination of crankcase oil from combustion products. However, dispersion-type manganese and iron compounds have not been shown to have any synergistic relationship for combustion catalysis.

Over-based magnesium (Mg) compounds are known in the art for converting trace metal contaminants into high melting compounds and reducing deposits in combustion turbine engines operated by liquid petroleum fuels containing trace metal contaminants such as vanadium, lead, sodium, potassium and calcium. These contaminants form low melting point corrosive deposits on hot metal parts in reciprocating engines, such as low-speed marine diesel engines. Magnesium is known to form high-melting salts with vanadium, sodium and other fuel contaminants. As a result, over-based magnesium compounds are used alone as fuel additives for compression-ignited reciprocating engines to reduce the effects of these contaminants. For example, an over-based magnesium compound has been used alone in a Wartsilla V32 18 cylinder 8 MW stationary diesel engine, to alleviate the effects of deposits and corrosion from the residual oil fuel used.

While the iron additives and the magnesium additives have been effective, a fuel additive that includes an improved combustion catalyst to further reduce smoke and particulate emissions from boilers, engines, and other equipment operating on fossil and other fuels would be advantageous.

SUMMARY OF THE INVENTION

The present invention includes a method and catalyst for improving combustion in boilers, combustion turbines, compression- and spark-ignited reciprocating engines, and other equipment operating on fossil and other fuels, wherein the catalyst is a fuel additive containing an oil-soluble iron compound and an over-based magnesium compound, and wherein the median size of the particles in the additive is less than about 0.01 micrometers. The term "over-based" is defined below. The method includes adding the fuel additive to the fossil or other fuel, wherein the median particle size of less than about 0.01 micrometers provides for increased catalytic activity in combustion processes.

In a preferred embodiment, the oil-soluble iron compound is ferric napthenate or iron napthenate salt, and the oil-soluble magnesium compound is over-based magnesium carboxylate and sulfonate mixture.

The invention includes a method of catalyzing combustion of liquid petroleum or other fuel in a boiler, engine, or other form of combustion equipment including adding an additive including an oil-soluble iron compound and an over-based magnesium compound to the fuel, and whereby the median size of the particles in the additive is less than about 0.01 micrometers. This method results in the boiler, engine, or other combustion equipment having improved performance and increased fuel efficiency.

BRIEF DESCRIPTION OF THE DRAWINGS

FIG. 4 shows the major atomic spectra lines for iron (III) and magnesium.

DETAILED DESCRIPTION OF THE PREFERRED EMBODIMENT OF THE PRESENT INVENTION

Figure 1:
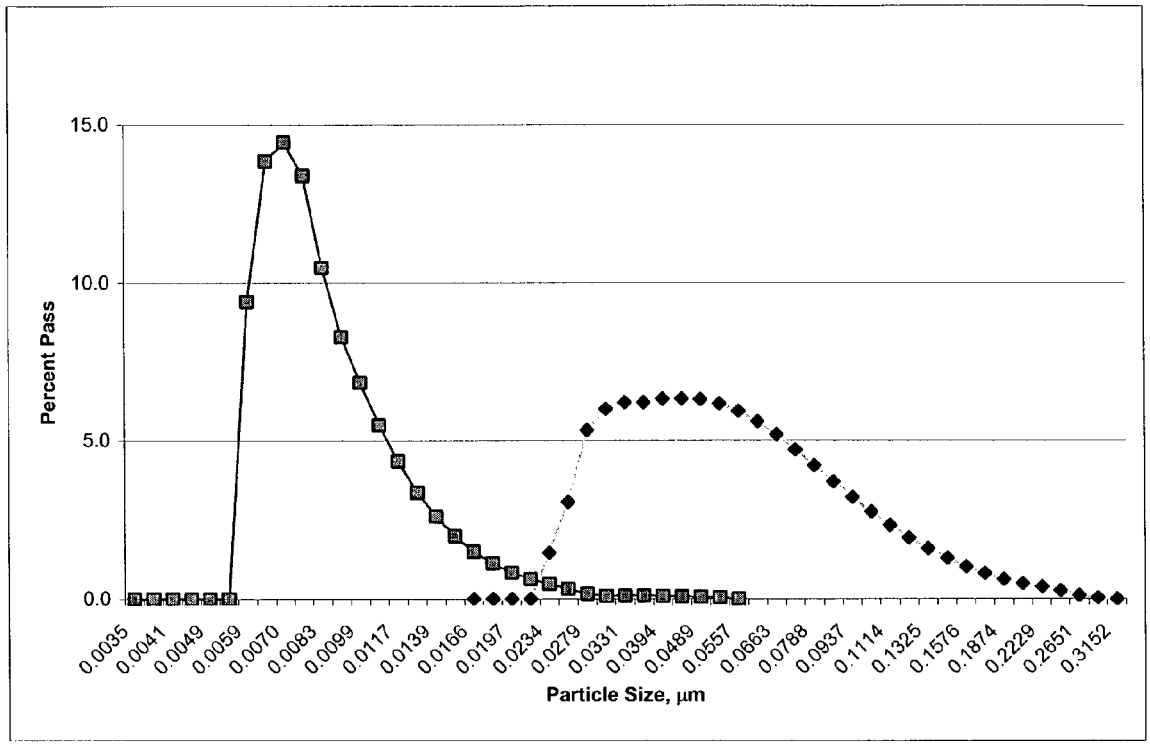
FIG. 1 shows a comparison between the median particle size in the present invention and the median particle size in a typical catalyst used in hydrocarbon fuels.

Field tests have shown that iron with a particle size of less than about 0.01 micrometers behaves as a true catalyst based on kinetic theory. For example, in U.S. patent application Ser. No. 10/192,261, it is discussed that oil-soluble iron combined with oil-soluble magnesium is a very effective combustion catalyst in compression-ignited (Diesel) reciprocating engines. The synergistic mixture of metals results in suppression of hydrocarbons in the exhaust (soot or smoke) and an 8 to 12% increase in fuel efficiency. Also, U.S. Patent Application Ser. No. 60/373,249 shows that oil-soluble iron combined with oil-soluble magnesium is a very effective combustion catalyst in spark-ignited reciprocating engines.

It has been determined that this novel combination of iron and magnesium in naphtha based fuels (gasoline) yields an unexpected increase in RON of 3 or more units. It has also been found that the iron compound employed in this product does not disassociate or form iron sulfides. This observation is entirely unexpected as iron compounds typically exhibit negative side effects as discussed above. It appears that catalysis occurs from release of energy by electrons decaying from highly energized to degenerate orbitals. This is observed in the emission spectra of the element. An examination of the emission spectra of iron and magnesium demonstrates a reinforcement of the energy by non-duplicated primary spectra lines. It is believed that the mechanism of catalysis is that the reaction of hydrocarbon with oxygen to form carbon dioxide and water is rapidly quenched by dilution with air and reduced temperature. The energy from decaying electrons in the metal catalyst re-energizes the reaction process so that combustion is completed. This results in lower temperatures of operation and reduced NOx formation.

A combination of an oil-soluble organo-metallic iron combustion catalyst with oil soluble magnesium to reduce vanadium deposits and corrosion has been shown to result in significant reduction of smoke in the exhaust of engines operating at steady state and non-equilibrium start-up conditions. Such a combination has also resulted in increased power, improved fuel economy and radically reduced smoke emissions in steam boilers and compression-ignited reciprocating engines. The iron-magnesium combination acts synergistically to give increased catalytic activity in such combustion processes. U.S. patent application Ser. No. 10/192,261, which is incorporated herein, discusses this combination.

The preferred iron compound used in the formulation is ferric napthenate. The iron-soluble compound is in the form of a colloidal dispersion of ferric oxide stabilized in a hydrocarbon solvent. Naphthenic acid is an aliphatic carboxylic acid with a phenyl group on the end of the chain opposite the carboxyl group. Iron oxide is reacted therewith to create ferric napthenate. The unsaturated ring will cause higher electron density in the carboxyl group with a lower ionization constant. The result is that the iron napthenate does not disassociate readily in a hydrocarbon system, even in the presence of a strong Lewis acid such as a sulfide ion. The addition of this additive allows the use of cheaper grades of gasoline as these gasolines can be significantly improved and made useable by such addition.

The additive of the invention also eliminates NOx formation as the fuel, without special adaptations, will burn at a lower temperature creating fewer pollutants as compared to iron and magnesium combinations of larger particle size.

While catalytic converters are required in vehicles, the use of a catalytic converter is made redundant through the additive as the additive alone reduces pollutants to meet regulations without the concurrent creation of NOx associated with higher temperatures.

Oil-soluble organic iron and magnesium compounds reduce smoke emission from combustion turbine exhausts by up to 80% at iron concentrations of up to 30 PPM when such engines are operated on liquid petroleum fuels. This has been demonstrated in a combustion turbine engine, such as a Westinghouse Model 501-F 150 MW engine. Combustion turbine engines are known to produce an excessive amount of smoke emissions and particulate matter during the start-up cycle due to unstable combustion. This may be due to large-sized fuel droplets resulting in inefficient combustion. An iron oxide dispersion product, such as that distributed by Turbotect, is known to reduce smoke emissions in combustion turbine engines, along with the negative side effects noted above. The current invention provides significant additional reduction without the negative side effects.

An examination of the spectra of magnesium, iron, copper and manganese reveals that the spectra lines of magnesium compliment the spectra lines of iron. There are virtually no duplicates or reinforcements. The magnesium spectra, by itself, does not yield energy in the areas that will spontaneously maintain combustion of hydrocarbons after the temperature is quenched. However, it is believed that the magnesium spectra are synergistic with the spectra of iron, thereby providing energy quanta (packets) that support and continue reaction of hydrocarbon with oxygen after the temperature is quenched below temperatures that would normally support spontaneous combustion. Therefore, it is believed that magnesium supports the catalytic effect of iron in a synergistic fashion that results in the additive being much more effective than iron alone. The longer burning time results in cooler temperatures, which in turn results in lower NOx formation.

The composition of one embodiment of this invention is a bimetallic combination of an oil-soluble iron compound in a colloidal dispersion and an over-based magnesium compound. The particles from the iron and magnesium compounds are suspended in solution. The particles may agglomerate to form a plurality of bimetallic particles. The particles have a size distribution and a median particle size less than about 0.01 micrometers. This limited median particle size results in increased catalytic combustion of fossil fuels, such as liquid petroleum fuels and solid hydrocarbon fuels, and other fuels, such as wood, in boilers, engines, and other combustion equipment when the additive is added to such fuels. The catalyzed combustion results in improved performance and increased fuel efficiency.

The method of improving combustion efficiency of a boiler or engine operating on a fossil or other fuel includes adding a fuel additive as a catalyst to the fuel, the fuel additive comprising a oil-soluble iron compound and an over-based magnesium compound, wherein the additive has a median particle size less than about 0.01 micrometers.

The combustion equipment in which the fuels with the additive of the present invention can be used include all types in which combustion can be catalyzed, including but not limited to combustion turbine engines, steam boilers, industrial boilers, package boilers, industrial heaters, and compression-ignited reciprocating engines of all kinds.

The preferred over-based magnesium compounds of this invention are selected from carboxylate, sulfonate, acetic and mixtures thereof. The term "over-based" refers to the excess amount of base as compared with the acid of the solution, the acid being provided by the carboxylic acid, sulfonic acid or acetic acid of the preferred embodiment.

The size of the particles in the fuel additive plays a role in catalytic activity. The particle size in the additive can be controlled during the manufacturing process. The additive of the present invention, with a median particle size less than about 0.01 micrometers, results in a significant improvement in performance over additives with larger median particle sizes. FIG. 1 shows the results of a particle size analysis comparing the additive of the present invention and a typical catalyst used in hydrocarbon fuels. The median particle size of the additive of the present invention is less than about 0.01 micrometers. At least 50% of the particles of the additive of this invention have a median particle size falling between 0.0001 and 0.0076 micrometers. At least 25% of the particles of the additive of this invention have a median particle size falling between 0.0001 and 0.0065 micrometers. By contrast, for a typical catalyst, the median particle size is shown to be greater than 0.016 micrometers.

Catalytic controlled reactions follow two laws. First, the order of the reaction is reduced by an order of one, and second, the rate of reaction is proportional to the concentration of the catalyst. It has been observed that the results from use of the present invention follow these two laws.

The first law for catalytically controlled reactions states that the addition of catalyst reduces the order of reaction by one. Hydrocarbon fuels contain a mixture of molecules with varying hydrogen to carbon ratios. Three examples of combustion reactions are:

| | |
|---|---|
| Methane | $CH_4 + O_2 = CO_2 + H_2O$ |
| Aliphatic | $—CH_2— + 3/2O_2 = CO_2 + H_2O$ |
| Asphaltenic | $—CH— + 5/2O_2 = CO_2 + 1/2H_2O$ |

The exact chemical reaction in the combustion process depends on the molecular structure and distribution of the fuel. For example, in the combustion-ignited reciprocating engine, oxygen present in air is compressed to ignition temperature and fuel is injected. While the air is in slight excess, it can be assumed that in the current invention a discreet $2^{nd}$ order reaction is occurring with two distinct reactants, hydrocarbon fuel and oxygen.

The activation energy and temperature relationship is defined by the following equation:

$$K=se^{-\Delta Ha/RT}$$

Where s is a constant and $\Delta H_a$ is the heat of activation. Set in logarithmic form, the equation becomes:

$$\ln k = \frac{-\Delta H_a}{RT} + \ln c$$

Differentiating this equation and integrating between limits yields:

$$\ln k_1/k_2 = \frac{\Delta H_a(T_2 - T_1)}{RT} + \ln c$$

Figure 2:
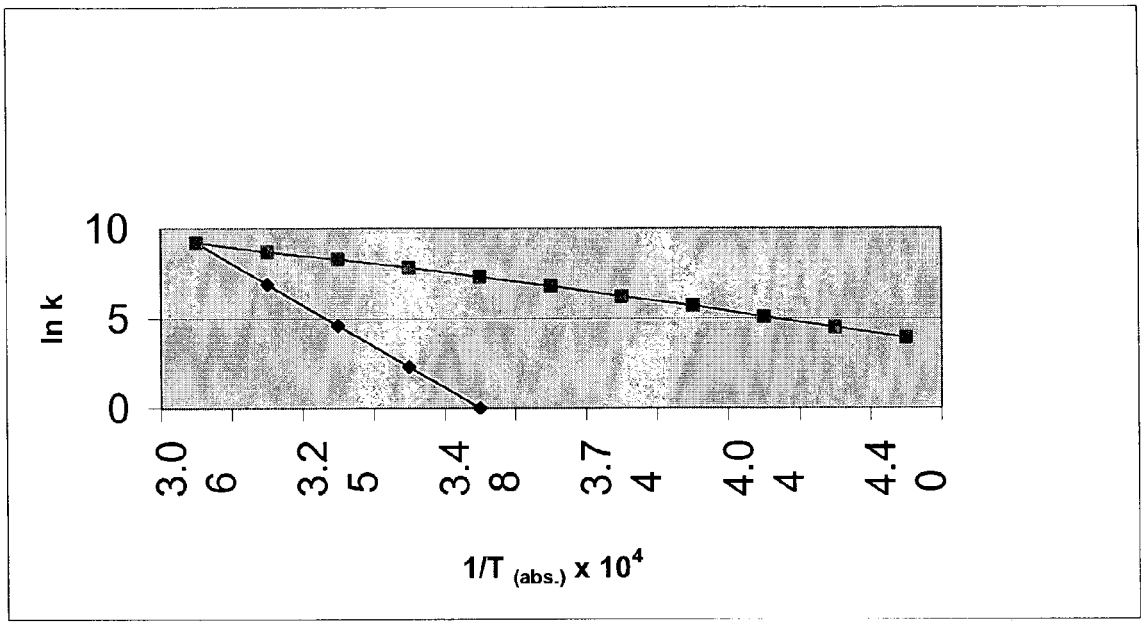
FIG. 2 shows a comparison of the activation energies for combustion catalyst reactions with and without the catalyst of the present invention.
Figure 3:
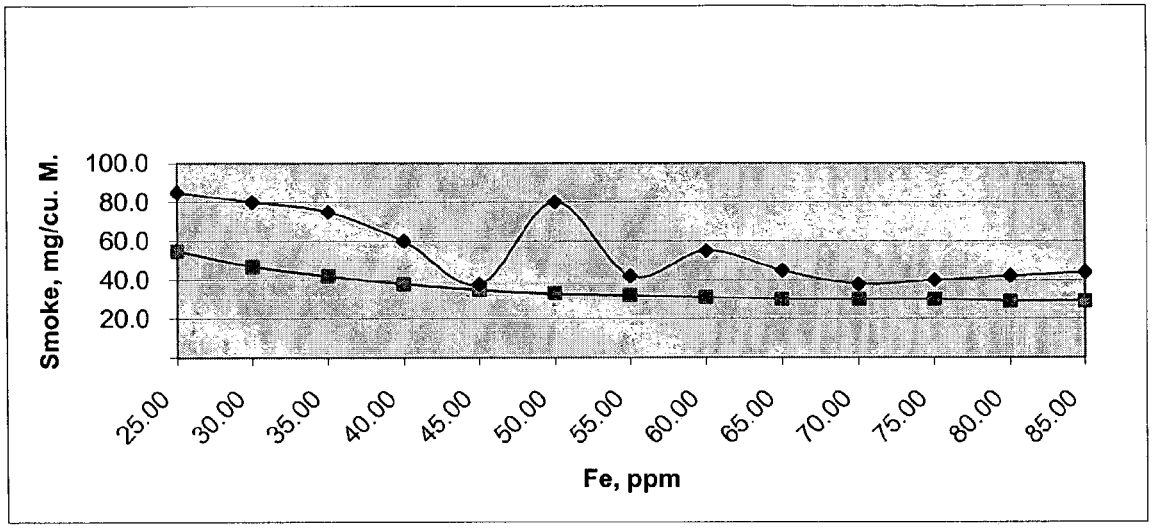
FIG. 3 shows the relationship between emission of particulate matter and catalyst concentration for the present invention and for a typical catalyst.

The Heat of Activation (ΔHa) is the slope of the plot of 1n k versus 1/T (oK). The slope of the line for the combustion reaction without catalyst is very steep indicating high activation energy is required to ignite the fuel. This is shown in line A of FIG. 2. With the catalyst, the reaction appears to continue at lower temperatures. This leads to a lower slope of the line indicating that the catalyst appears to lower the activation energy for the reaction. This is illustrated in Line B of FIG. 2.

The next problem is the ramification of reducing the reaction order by one. The rate expression for a classic second order reaction is:

$$dx/dt=k_2(a-x)(b-x)$$

The integrated form of this equation is:

$$k_2t=1/(a-b)\ln(b(a-x))/a(b-x))$$

The reaction rate will follow a logarithmic decay as the reactants are consumed. The combustion process has a high activation energy indicated by the temperature required to cause combustion. The immediate reaction of fuel and oxygen results in an increase in temperature of the gaseous phase reactants and products. For example, high pressure in the piston chamber of an engine resulting from the heat of combustion is converted to kinetic energy as the hot gasses expand, reduce temperature and provide work that causes the piston to move transferring kinetic energy to the crankshaft. This is followed by an immediate reduction in temperature in the piston chamber.

If the chemical reactants are of sufficient molecular weight and structural complexity to reduce the rate of reaction, the temperature can drop below the level for the activation energy allow reaction to continue before reaction is complete. It is believed that the result is unreacted hydrocarbon in the exhaust stream resulting in smoke.

The second law of catalysis requires that the effect is proportional to concentration of the catalyst. The rate expression for a classic first order reaction is:

$$-d(a-x)/dt=k_1(a-x)$$

The integrated form of this equation is:

$$k_1t=\ln(a/(a-x))$$

Therefore, with catalysis the reaction will follow the decay of the concentration limiting reactant, generally the fuel in steady state conditions. Under accelerating conditions the reaction will follow the oxygen level when excess fuel is injected into the piston chamber. This is observed as smoke not entirely eliminated during acceleration.

The effect is directly proportional to the catalyst concentration. Field tests have shown the smoke reduction follows an asymptotic curve up to about 50 ppm iron. Since the catalytic effect (under steady state conditions) is the only observation beyond the fact that fuel and oxygen remain in "infinite" supply in the combustion chamber, the system appears to have reduced to a pseudo zero-order reaction.

The present invention has several advantages. Smoke and particulate emissions from boilers, engines, and other equipment are reduced by-over about 90%, based on visual observations, using the method and oil-soluble iron and over-based magnesium composition with the particle size described in this invention. Engines using the method and composition of this invention produced increased horsepower during vehicle acceleration and operated more smoothly with less vibration and "knocking". Further, the fuel efficiency of such engines also increased from a minimum of 10% to as much as 20%. In empirical field tests, there has been no evidence of maintenance problems or damage to the engines as a result of using the fuel additive containing the composition of this invention.

To use the additive, a mixture is formed with the fuel prior to or during combustion, either before or after the fuel has been introduced to the combustion equipment. Any traditional method of adding the additive is encompassed herewith. For example, the additive can be added in-line as the fuel is pumped to the engine or boiler.

This invention avoids the use of toxic metals such as lead in exhausts. Ferric oxide resulting from combustion of the additive is rust, a widely prevalent material in nature that is benign to biological life forms. Ferric sulfide precipitate is also avoided. The iron napthenate and the magnesium oxide combination is non-toxic and non-carcinogenic in normal applications. While ingestion and prolonged contact with skin is not recommended, the material can be washed off skin with soap and water, and safely eliminated from the body with emetics. Other methods of practicing the invention would include other chemical forms used to create an iron and magnesium product with the appropriate particle size and introducing the product to the fuel through various techniques.

While the present invention has been described and/or illustrated with particular reference to a fuel additive that is a combustion catalyst for combustion turbine engines, steam boilers, industrial boilers, package boilers, industrial heaters, and compression-ignited reciprocating engines, and other equipment operating on fossil and other fuels wherein the median particle size in the additive is less than about 0.01 micrometers, it is noted that the scope of the present invention is not restricted to the particular embodiment(s) described. It should be apparent to those skilled in the art that the scope of the invention includes the use of the fuel additive in other boilers, engines and equipment than those specifically described. Moreover, those skilled in the art will appreciate that the invention described above is susceptible to variations and modifications other than those specifically described. It is understood that the present invention includes all such variations and modifications which are within the spirit and scope of the invention. It is intended that the scope of the invention not be limited by the specification, but be defined by the claims set forth below.

It is claimed:

1. A catalyst for improving combustion, the catalyst comprising: a dispersion including suspended particles, the suspended particles having a size distribution and a median particle size, wherein at least a portion of the particles includes a magnesium compound and an iron compound in the form of a colloidal dispersion including ferric oxide stabilized in a hydrocarbon solvent, wherein die median particle size is less than about 0.01 micrometers, and wherein the magnesium compound is over-based.

2. A catalyst for improving combustion, the catalyst comprising: a dispersion including suspended particles, the suspended particles having a size distribution and a median particle size, at least a portion of the particles including an iron compound and a magnesium compound, wherein the median particle size is less than about 0.01 micrometers, and wherein the magnesium compound is over-based and includes magnesium carboxylate.

3. A catalyst for improving combustion, the catalyst comprising: a dispersion including suspended particles, the suspended particles having a size distribution and a median particle size, at least a portion of the particles including an iron compound and a magnesium compound, wherein the median particle size is less than about 0.01 micrometers, and wherein the magnesium compound is over-based and includes a mixture of magnesium carboxylate, carbonate, and magnesium sulfonate.

4. A catalyst for improving combustion, the catalyst comprising: a dispersion including suspended particles, the suspended particles having a size distribution and a median particle size, at least a portion of the particles including an iron compound and a magnesium compound suspended in liquid and agglomerating to form a plurality of bimetallic particles, said particles having a size distribution and a median particle size, wherein the median particle size is less than about 0.01 micrometers and wherein the magnesium compound is over-based.

5. The catalyst of claim 4, wherein at least 50% of the particles have a median particle size between 0.0001 and 0.0076 micrometers.

6. The catalyst of claim 4, wherein at least 25% of the particles have a median particle size between 0.0001 and 0.0065 micrometers.

7. The catalyst for claim 4, wherein the iron compound is oil-soluble.

8. The catalyst of claim 4, wherein the magnesium compound includes magnesium carboxylate.

9. The catalyst of claim 4, wherein the magnesium compound includes magnesium sulfonate.

10. The catalyst of claim 4, wherein the magnesium compound includes a mixture of magnesium carboxylate and magnesium sulfonate.

11. A method of catalyzing fuel combustion in combustion equipment comprising the steps of: creating a solution in which particles are suspended, the particles having a size distribution and a median particle size, the median particle size less than about 0.01 micrometers, and the particles containing an iron compound and a magnesium compound; and adding the dispersion to the fuel, wherein the magnesium compound is over-based.

12. The method of claim 11, wherein at least 50% of the particles have a median particle size between 0.0001 and 0.0076 micrometers.

13. The method of claim 11, wherein at least 25% of the particles have a median particle size between 0.0001 and 0.0065 micrometers.

14. The method of claim 11, wherein the iron compound is oil-soluble.

15. The method of claim 11, wherein the magnesium compound includes magnesium carboxylate.

16. The method of claim 11, wherein the magnesium compound includes magnesium sulfonate.

17. The method of claim 11, wherein the magnesium compound includes a mixture of magnesium carboxylate and magnesium sulfonate.

18. The method of claim 11, in which the fuel comprises fossil fuels.

19. The method of claim 11, wherein the fuel is selected from a group consisting of liquid petroleum fuels, solid hydrocarbon fuels, and wood.

20. The method of claim 11, wherein the combustion equipment is selected from the group consisting of combustion turbine engines, steam boilers, industrial boilers, package boilers, industrial heaters, spark-ignited reciprocating engines, and compression-ignited reciprocating engines.

* * * * *